US010204607B2

(12) United States Patent
Haines

(10) Patent No.: US 10,204,607 B2
(45) Date of Patent: Feb. 12, 2019

(54) ROTATABLE MOUTHPIECE FOR A WOODWIND INSTRUMENT

(71) Applicant: Raymond Stanley Haines, Jersey Shore, PA (US)

(72) Inventor: Raymond Stanley Haines, Jersey Shore, PA (US)

( * ) Notice: Subject to any disclaimer, the term of this patent is extended or adjusted under 35 U.S.C. 154(b) by 9 days.

(21) Appl. No.: 15/705,466

(22) Filed: Sep. 15, 2017

(65) Prior Publication Data

US 2018/0075826 A1 Mar. 15, 2018

Related U.S. Application Data

(60) Provisional application No. 62/394,876, filed on Sep. 15, 2016.

(51) Int. Cl.
*G10D 9/02* (2006.01)
*G10D 7/08* (2006.01)

(52) U.S. Cl.
CPC ..... *G10D 9/023* (2013.01); *G10D 7/08* (2013.01)

(58) Field of Classification Search
CPC ..... G10D 9/023
See application file for complete search history.

(56) References Cited

U.S. PATENT DOCUMENTS

| | | | | |
|---|---|---|---|---|
| 5,249,499 | A | 10/1993 | Goldstein et al. | |
| 5,398,582 | A | 3/1995 | Smith | |
| 5,929,353 | A | 7/1999 | Taninbaum | |
| 8,283,540 | B2 * | 10/2012 | Slater | G10D 9/005 84/380 R |
| 8,502,054 | B2 | 8/2013 | Warburton | |
| 9,218,796 | B2 | 12/2015 | Ferrando | |
| 2013/0312584 | A1 | 11/2013 | Warburton | |
| 2015/0269918 | A1 | 9/2015 | Wang | |

* cited by examiner

*Primary Examiner* — Kimberly R Lockett
(74) *Attorney, Agent, or Firm* — Wendy W. Koba

(57) ABSTRACT

A mouthpiece configuration for a wind instrument (such as a saxophone) is provided that is rotatable with respect to the neck, while remaining stationary with respect to the musician. The inventive mouthpiece comprises an inner sleeve component that is inserted over the neck of the instrument, where the inner sleeve component is formed to include a rotatable outer surface element (e.g., slip ring, ball bearings, etc.), referred to as a "bearing surface" that provides rotational movement. A mouthpiece element is positioned over the inner sleeve component to engage with the rotatable outer surface element such that a player may easily rotate the mouthpiece element with respect to the remainder of the instrument.

8 Claims, 4 Drawing Sheets

ROTATABLE MOUTHPIECE FOR A WOODWIND INSTRUMENT

CROSS-REFERENCE TO RELATED APPLICATIONS

This application claims the benefit of U.S. Provisional Application Ser. No. 62/394,876, filed Sep. 15, 2016 and herein incorporated by reference.

TECHNICAL FIELD

The present invention relates to an improved instrument mouthpiece and, more particularly, to a mouthpiece configuration that is rotatable with respect to the neck of the instrument, while remaining stationary with respect to the musician.

BACKGROUND OF THE INVENTION

In various circumstances, a woodwind instrument player (particularly, a saxophone player) may move between a sitting position and a standing position while continuing to play. Obviously, the reverse is equally true, and an individual that has been standing (to play a solo, for example), returns to a sitting position while continuing to play.

When the musician is seated, the may be positioned to his right side, at an angle (for example, many types of saxophones, bass clarinet, or the like). When standing, the musician holds the instrument directly in front of him (i.e., parallel to his body). Obviously, this change in position between the instrument and the musician means that the orientation of the mouthpiece with respect to the musician changes (since the mouthpiece is fixed in place along the neck of the instrument). Thus, if one observes a saxophone player, you may see him take the time to adjust the position of the mouthpiece (sometimes while continuing to play—one hand used to twist the mouthpiece around on the neck, while playing some notes with the other hand).

Clearly, the need for the musician to adjust the position of the mouthpiece while continuing to play is awkward. Additionally, it is possible that the musician may slightly change the position of the mouthpiece a long the neck (unintentionally), which may affect the tuning of the instrument.

SUMMARY OF THE INVENTION

These and other problems are addressed by the present invention, while relates to an improved woodwind instrument mouthpiece and, more particularly, to a mouthpiece configuration that is rotatable with respect to the neck of the instrument, while remaining stationary with respect to the musician.

In accordance with one or more embodiments of the present invention, the inventive mouthpiece comprises an inner sleeve component that is inserted over the neck of the instrument and positioned to remain stationary during use. The inner sleeve component is formed to include one or more rotatable elements on its outer surface (referred to at times hereafter as a "bearing surface") that provides rotational movement of the inner sleeve with respect to a mouthpiece placed over the inner sleeve. In accordance with the present invention, a mouthpiece element is formed to include indentations that align with the rotatable elements, creating the bearing surface such that a player may easily rotate the mouthpiece element with respect to the neck.

In one exemplary embodiment, a rotatable mouthpiece of the present invention takes the form of an inner sleeve for positioning over a neck of the wind instrument in a manner where the inner sleeve remains stationary after positioning (the inner sleeve including at least one outer indentation formed around an outer periphery thereof), and a mouthpiece element for positioning over the inner sleeve and including at least one inner indentation around an inner periphery thereof. The mouthpiece element indentation(a) align with the inner sleeve indention(s) upon positioning. A bearing element is disposed within the cavity created by the aligned indentations, forming a bearing surface such that the mouthpiece element is rotatable with respect to the inner sleeve.

Other and further embodiments of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
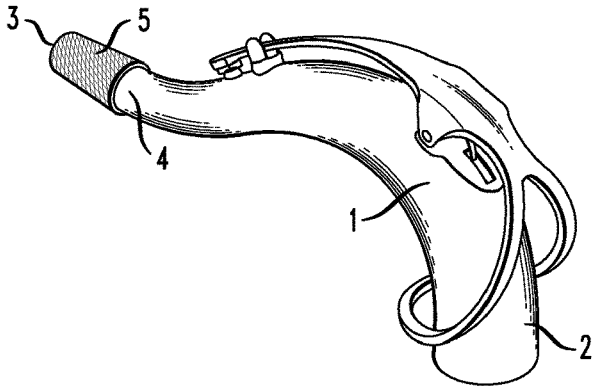
FIG. 1 PRIOR ART
FIG. 1 depicts a conventional neck piece of a saxophone.

FIG. 1 illustrates a conventional "neck" 1 of a saxophone. A first, wide diameter opening 2 of neck 1 mates with the main body of the instrument (not shown). A second, narrower diameter opening 3 of neck 1 mates with the mouthpiece (also not shown in this view). A terminal portion 4 of neck 1 is covered by a sealing material 5 (typically, cork) used to create a relatively air-tight connection between the mouthpiece and the neck.

Figure 2:
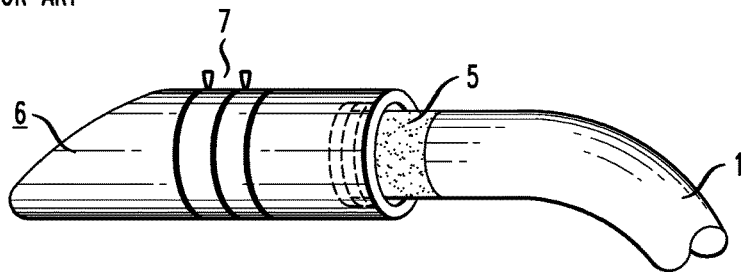
FIG. 2 PRIOR ART
FIG. 2 illustrates a prior art mouthpiece as in position over the neck piece of a saxophone as shown in FIG. 1.

FIG. 2 illustrates, in simplified form, a conventional mouthpiece 6 as disposed in place over cork 5 on terminal portion 4 of neck 1. A ligature apparatus 7 for holding a reed in place is also shown in FIG. 2. As shown, an interior surface 8 of mouthpiece 6 contacts cork 5 and functions to hold mouthpiece 6 in place (and stationary) with respect to neck 1.

As mentioned above, it is this "stationary" attachment of mouthpiece 6 to neck 1 that leads to problems in performance. While the above illustrations are typical for an alto saxophone, it is to be understood that the inventive rotatable mouthpiece may be used with any other type of saxophone (e.g., tenor, baritone, or the like) or any other woodwind instrument where the musician would like the ability to rotate the mouthpiece with respect to the instrument itself.

Figure 3:
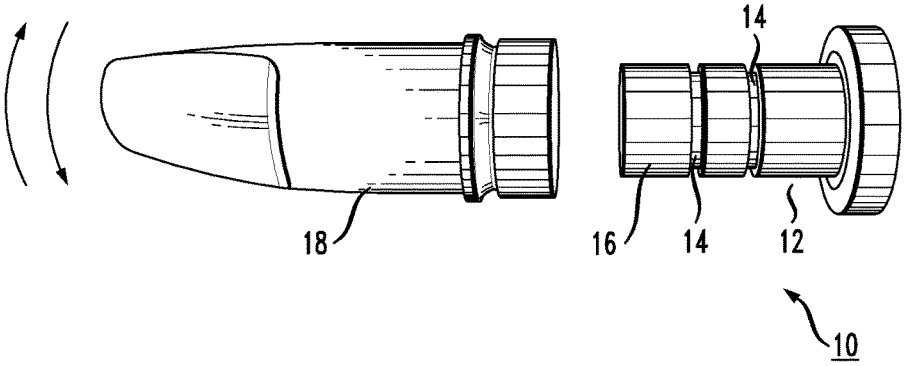
FIG. 3 is an exploded view of an exemplary embodiment of the present invention, showing an inner sleeve with a rotatable outer surface element and a separate mouthpiece element.

FIG. 3 illustrates, in an exploded view, an inventive rotatable woodwind instrument mouthpiece 10 formed in accordance with the present invention. As will described in detail below, rotatable mouthpiece 10 includes an inner sleeve component 12 that mates with, and remains stationary with respect to, a neck of an instrument (such as neck 1, shown above). As with the prior art, it is presumed that in most cases inner sleeve 12 will be placed over a cork lining formed at an end termination of the instrument's neck. Inner sleeve 12 is shown as including a plurality of indentations 14 formed around an outer periphery 16 of sleeve 12. In use, a separate bearing element (not shown) is disposed in each indentation.

Mouthpiece 10 further comprises a mouthpiece component 18 that fits over inner sleeve 12 in a manner where component 18 is free to rotate with respect to sleeve 12 by virtue of the inclusion of bearing elements within indentations 14 on outer periphery 16 of inner sleeve, the inclusion of the bearing elements creating a bearing surface 13 between inner sleeve 12 and component 18. Therefore, a musician is able to adjust the position of mouthpiece component 18 relative to the instrument by holding component 18 in place within his mouth and rotating the instrument itself (via bearing surface 13) by easily adjusting the position of his arms.

Figure 4:
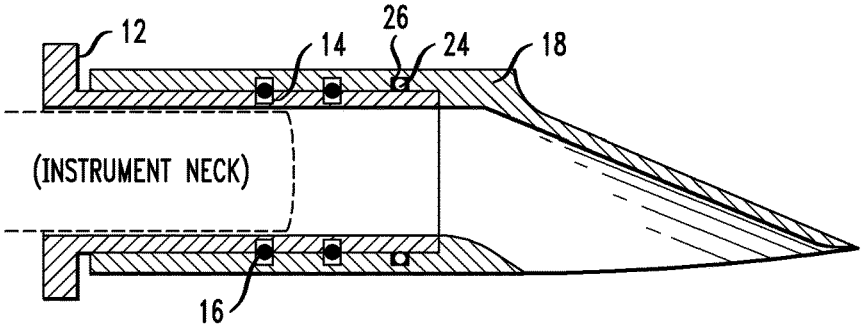
FIG. 4 is a cut-away side view of the inner sleeve element of FIG. 3.

FIG. 4 is a cut-away view of inner sleeve 12 as in place within mouthpiece component 18. Indentations 14-1 and 14-2 are visible in this view. It is to be understood that the use of a pair of indentations is exemplary only; it is possible to utilize only a single indentation in a given embodiment of the present invention, and also possible to use three or more such indentations. Also shown is a plurality of bearing elements, in this case taking the form of a pair of snap rings 20, a separate snap ring positioned to rest within an associated indentation (i.e., snap ring 20-1 disposed within indentation 14-1 and snap ring 20-2 disposed within indentation 14-2). In accordance with this embodiment of the present invention, indentations 14 are sized such that a small portion of snap rings 20 extends beyond the limit of outer periphery 16, thus creating bearing surface 13 around which mouthpiece component 18 is free to rotate. Mouthpiece component 18 is shown as comprising a like plurality of indentations 22 (here, a pair of indentations 22-1 and 22-2) that engage these exposed portions of snap rings 20, thus creating the bearing surface necessary to provide rotation of the mouthpiece with respect to the instrument. While only two such indentations are shown in this exemplary embodiment, it is to be understood that fewer or more combinations of bearing elements and indentations may be used. In other embodiments, a round wire element or a ball bearing may be used as a bearing element instead of the snap rings.

Also shown in this view is an O-ring 24 that is disposed within a channel 26 formed in mouthpiece component 18. O-ring 24 functions as a sealing ring to maintain an "air tight" attachment between mouthpiece component 18 and sleeve 12, regardless of the rotation of one element with respect to the other. O-ring 24 may comprise a standard rubber O-ring.

Figure 5:
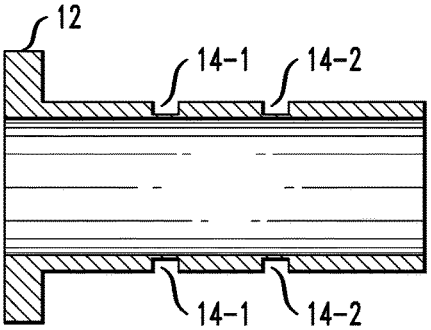
FIG. 5 is a cut-away side view of the mouthpiece element of FIG. 3.
Figure 6:
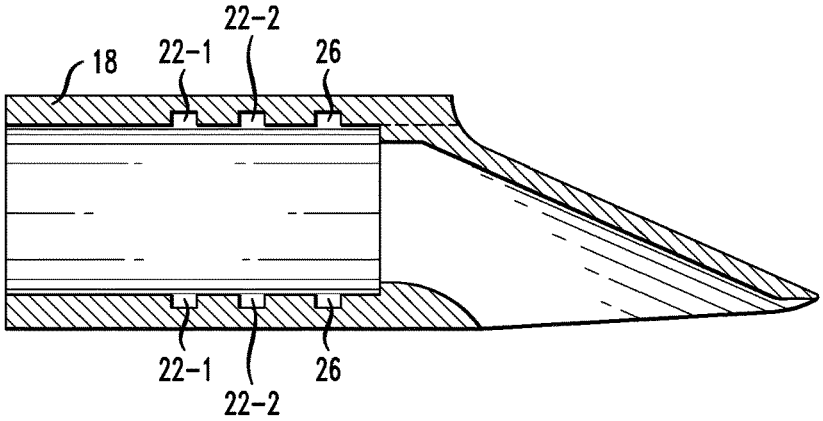
FIG. 6 is a cut-away side view of an exemplary rotatable mouthpiece formed in accordance with the present invention, illustrating a bearing surface for providing rotation of the mouthpiece element with respect to the inner sleeve.

FIG. 5 is a view of inner sleeve component 12 from the combined configuration of FIG. 4. The position of indentations 14 is clearly shown in this view. FIG. 6 is a view of mouthpiece component 18 from the combined configuration of FIG. 4. The position of O-ring indentation 26 and snap ring indentations 22 within mouthpiece component 18 are clearly shown in this view.

Figure 7:
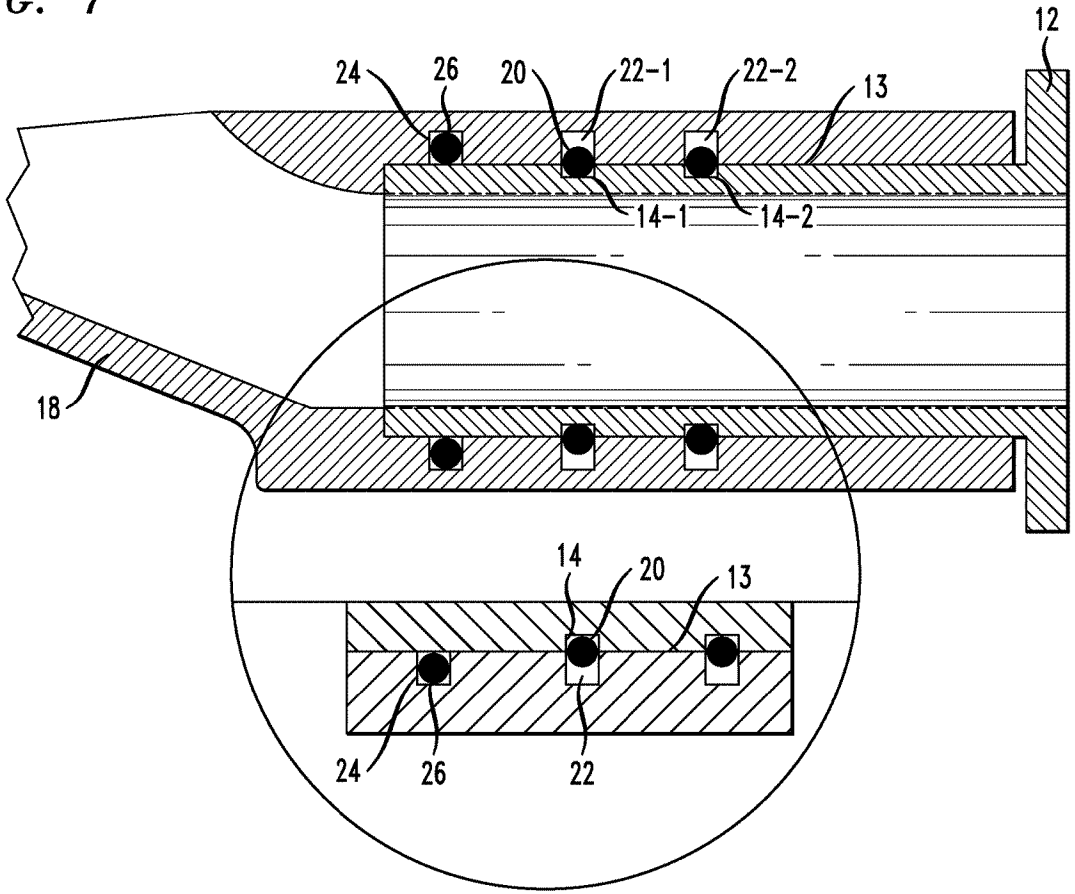
FIG. 7 is an enlargement of a portion of FIG. 6.

FIG. 7 is an enlarged view of the region where mouthpiece component 18 mates with inner sleeve 12 in a manner such that slip rings 20 engage the similar indentations formed on each element (i.e., "outer indentations" 14 on inner sleeve 12 and "inner indentations" 22 on mouthpiece component 18). As a result, bearing surface 13 is formed between inner sleeve 12 and mouthpiece 18 in accordance with the present invention, allowing a player to rotate the position of the mouthpiece with respect to the neck of the instrument without the need to manually move the mouthpiece in the manner necessary in the prior art.

Figure 9:
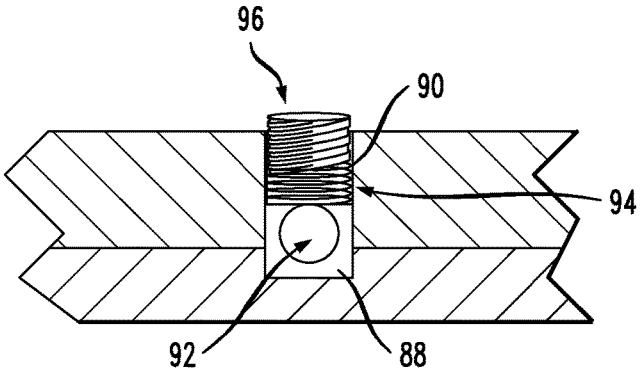
FIG. 9 is an enlargement of a portion of FIG. 8.
Figure 8:
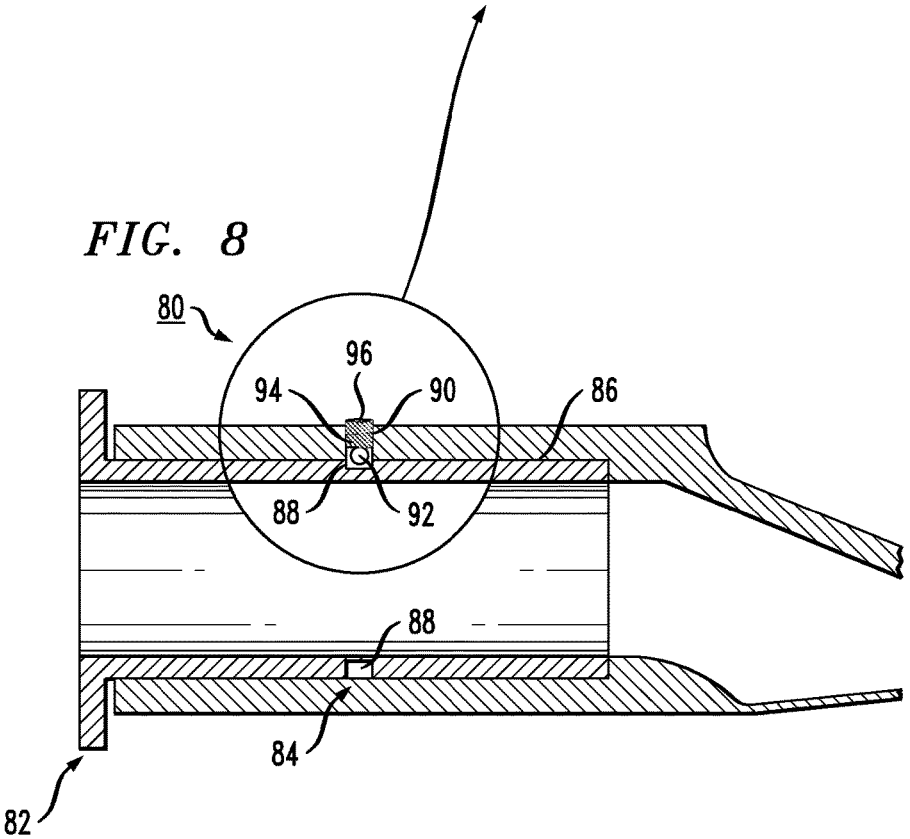
FIG. 8 is a cut-away side view of another embodiment of the present invention, in this case uses a spring-loaded set screw to adjust the force required by the musician to rotate the mouthpiece with respect to the instrument.

FIG. 8 is a cut-away view of an alternative embodiment of the present invention, and FIG. 9 is an enlarged view of the rotatable portion of this alternative embodiment. As with the above-described embodiment, a rotatable mouthpiece 80 as shown in FIG. 8 includes an inner sleeve 82 that is positioned in place over the neck of an instrument (not shown), and a mouthpiece component 84 that is positioned over inner sleeve 82. A bearing surface 86 is created between inner sleeve 82 and mouthpiece component 84 such that a player can adjust the relative position of mouthpiece 80 with respect to the rest of the instrument (e.g., between sitting and standing while continuing to play) without having the manually adjust the position of the mouthpiece.

In the embodiment of FIG. 8, bearing surface 86 includes an indentation 88 formed around the outer periphery of inner sleeve 82. Mouthpiece component 84 is shown as including a through-hole aperture 90 that aligns with indentation 88. As shown, a properly-sized retaining ball 92 is disposed to rest within indentation 88 and also engage with aperture 90. Retaining ball 92 thus forms the bearing surface relationship between inner sleeve 82 and mouthpiece component 84.

In accordance with this embodiment of the present invention, the force required to change the position of mouthpiece component 84 with respect to inner sleeve 82 (as applied by the player's mouth) is adjustable via an included force adjustment element. In this particular example, the force adjustment element comprises a spring 94 and set screw 96 disposed as shown within aperture 90. In use, a player adjusts the depth of set screw 96 within aperture 90, which in turn changes the tension applied by spring 94 against retaining ball 92. Therefore, a player is able to adjust the tension to suit his individual preference, ranging from preventing any rotational motion (spring fully compressed) to relatively free rotation of the mouthpiece with respect to the inner sleeve (spring fully expanded)—with any appropriate degree of tension between these two extremes available.

It is to be understood that the inventive mouthpiece may be used with any type of saxophone, including but not limited to, soprano, alto, baritone, bass, and the like. Moreover, the inventive mouthpiece may be used in any instrument that is a single-reed mouthpiece (for example, with a clarinet).

As described above, although the present invention has been explained by way of limited examples, the present invention is not intended to be limited thereby, and any person having ordinary skill in the art to which the invention pertains will be able to carry out various modifications that are considered to fall within the spirit and scope of the present invention. Indeed, the scope of the present invention is intended to be limited only by the metes and bounds of the claims appended hereto.

What is claimed is:

1. A rotatable mouthpiece for a wind instrument comprising an inner sleeve for positioning over a neck of the wind instrument in a manner where the inner sleeve remains stationary after positioning, the inner sleeve including at least one outer indentation formed around an outer periphery thereof;

a mouthpiece element for positioning over the inner sleeve and including at least one inner indentation around an inner periphery thereof, the mouthpiece element indentation aligning with the inner sleeve indention upon positioning; and a bearing element disposed within the aligned indentations, creating a bearing surface such that the mouthpiece element is rotatable with respect to the inner sleeve.

2. The rotatable mouthpiece as defined in claim 1 wherein the at least one outer indentation comprises a plurality of indentations and the at least one inner indentation comprises a plurality of indentations, each outer indentation aligned with an inner indentation in a one-to-one relationship.

3. The rotatable mouthpiece as defined in claim 1 wherein the bearing element comprises a slip ring.

4. The rotatable mouthpiece as defined in claim 1 wherein the bearing element comprises one or more ball bearings.

5. The rotatable mouthpiece as defined in claim 1 wherein the bearing element comprises a round wire.

6. The rotatable mouthpiece as defined in claim 1 wherein the mouthpiece element further comprises an aperture terminating at the inner indentation; and a rotation force adjusting element disposed within the aperture for changing a force applied against the bearing element.

7. The rotatable mouthpiece as defined in claim 6 wherein the rotational force adjusting element comprises a spring disposed within the aperture to contact the bearing element and a set screw disposed over the spring and extending beyond a surface of the mouthpiece element, wherein the setscrew may be adjusted into and out of the aperture to adjust a tension applied to the bearing element by the spring.

8. The rotatable mouthpiece as defined in claim 1 wherein the mouthpiece element further comprises a channel formed around an inner periphery thereof, the channel for supporting a sealing ring.

* * * * *